US005419271A

United States Patent [19]

Tweet et al.

[11] Patent Number: 5,419,271

[45] Date of Patent: May 30, 1995

[54] BILGE PUMP CONTROL SYSTEM FOR PERSONAL WATERCRAFT

[75] Inventors: Ole E. Tweet; James D. Mattison, both of Thief River Falls, Minn.

[73] Assignee: Arctco, Inc., Thief River Falls, Minn.

[21] Appl. No.: 200,155

[22] Filed: Feb. 24, 1994

[51] Int. Cl.[6] ..... B63B 13/00

[52] U.S. Cl. ..... 114/183 R; 114/270

[58] Field of Search ..... 114/270, 183 R, 183 A, 114/184, 185, 197, 198, 211, 212, 121, 125, 360, 68, 221 R, 227; 137/397; 74/551.8; 440/38

[56] References Cited

U.S. PATENT DOCUMENTS

| | | | |
|---|---|---|---|
| 4,341,178 | 7/1982 | Price | 114/183 R |
| 4,630,703 | 12/1986 | Fletcher | 74/551.8 |
| 4,676,759 | 6/1987 | Murase | 114/270 |
| 4,697,535 | 10/1987 | Wileman, III | 114/198 |
| 4,779,704 | 10/1988 | Akiyama | 181/235 |
| 4,787,328 | 11/1988 | Inoue | 114/270 |
| 4,850,908 | 7/1989 | Nakase et al. | 114/270 |
| 4,913,075 | 4/1990 | Rohr | 114/185 |
| 4,981,121 | 1/1991 | Tani | 123/179 |
| 5,171,171 | 12/1992 | Tani | 114/270 |

*Primary Examiner*—Edwin L. Swinehart

[57] ABSTRACT

A bilge pump control system for a personal watercraft which allows for the continuous pumping of the bilge whenever the vessel's engine is operating, but which also permits an operator to activate the bilge pump upon command even when the engine is not operating.

3 Claims, 5 Drawing Sheets

BILGE PUMP CONTROL SYSTEM FOR PERSONAL WATERCRAFT

BACKGROUND OF THE INVENTION

1. Field of the Invention

This invention relates to a small, personal watercraft powered by a jet propulsion system. More particularly, this invention relates to a control system for a bilge pump in such a watercraft.

2. Discussion of Related Art

A personal size watercraft, designed primarily for one to three riders, typically utilizes a jet propulsion system powered by an internal combustion engine. The engine crankshaft is coupled directly to the driveshaft of the jet device, so that the jet pump impeller functions whenever the engine is running. The vessel is propelled in a forward direction through drawing water into a chamber on the underside of the hull and forcefully exhausting the water in a rearward direction by the jet propulsion device. In normal use, the operator sits on a bench-type seat positioned centrally on the watercraft, and steers the vessel by means of handlebars which control the direction of flow of jet-propelled water from the stern.

Owing to the small size of the vessel, desired operating characteristics are highly dependent upon proper weight distribution. Thus, continuous removal of any water that enters the bilge area is critical to efficient operation. Existing personal watercraft are equipped with a bilge pump that pumps continuously whenever the engine is running. In this way, water cannot accumulate within the bilge and thus cannot adversely affect the weight distribution.

This dedicated use of the bilge pump, while essential to the normal operation of the vessel, has several distinct disadvantages in other situations. For example, when the vessel is at shore, starting the engine may not be a desirable or convenient means to pump out the bilge. Or when the vessel is stationary at some remote location, as when used for fishing, the operator may not wish to start the engine in order to activate the bilge pump.

Personal watercraft have been equipped with a drain plug to drain water from the bilge without starting the engine. This draining procedure involves elevating the bow of the vessel so that water may drain from the drain plug near the stern. In each of the situations described above, such a draining procedure would be difficult or impossible. An additional disadvantage of the drain plug is that the bilge may fill with water if that drain plug is not securely replaced prior to starting the engine.

A principal object of this invention, therefore, is to overcome the difficulties noted above, while retaining the salutary features of the existing bilge pump systems and assuring the safe control of the vessel.

SUMMARY OF THE INVENTION

The present invention relates to a bilge pump system which operates continuously when the engine of the watercraft is running, but which can be initiated upon command without activating the engine. The invention provides a secondary power connection to the bilge pump, with at least one appropriate control switch, to permit activation of the pump at any time. A control switch may be located at any of a number of positions on the vessel that provide easy access by the operator, under a variety of circumstances. Such a location may be on the handlebars of the vessel, for use when the operator is in the normal operating position. Or a switch may be located on the outer hull of the vessel to accommodate an operator who happens to be adjacent to the vessel, either on land or in the water.

DETAILED DESCRIPTION OF PREFERRED EMBODIMENTS

Figure 1:
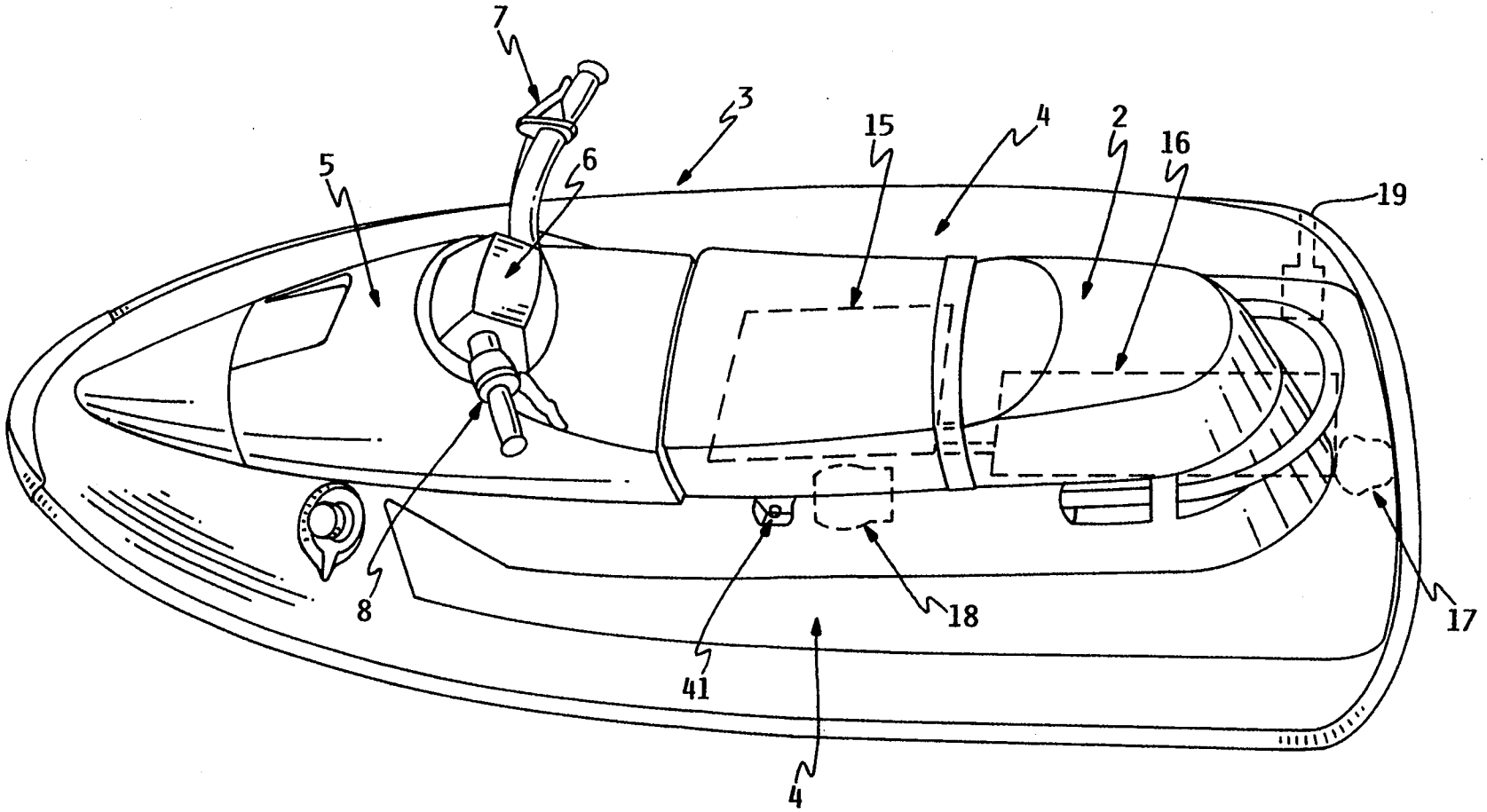
FIG. 1 is a top perspective view of an entire personal watercraft of the type in which the invention may be used.

As indicated, the invention relates to a personal watercraft of the type shown in FIG. 1, wherein the watercraft 10 is equipped with a removable seat 2, atop a hull 3. On either side of seat 2 are generally flat portions of a deck, defining a footrest areas 4. The forward deck area is raised to form a curved hood 5, upon which is mounted the handlebar hub 6 and handlebars 7 and 8.

Shown as dotted lines in FIG. 1 are components of the vessel which are contained within hull 3 beneath seat 2. Generally beneath seat 2 are the engine 15, the jet impeller drive assembly 16, which leads to the movable jet exhaust port 17. Jet exhaust port 17 rotates laterally in response to rotational motion of the handlebars to change the direction of motion of the vessel. Also beneath the seat are battery 18 and bilge pump assembly 19.

Figure 2:
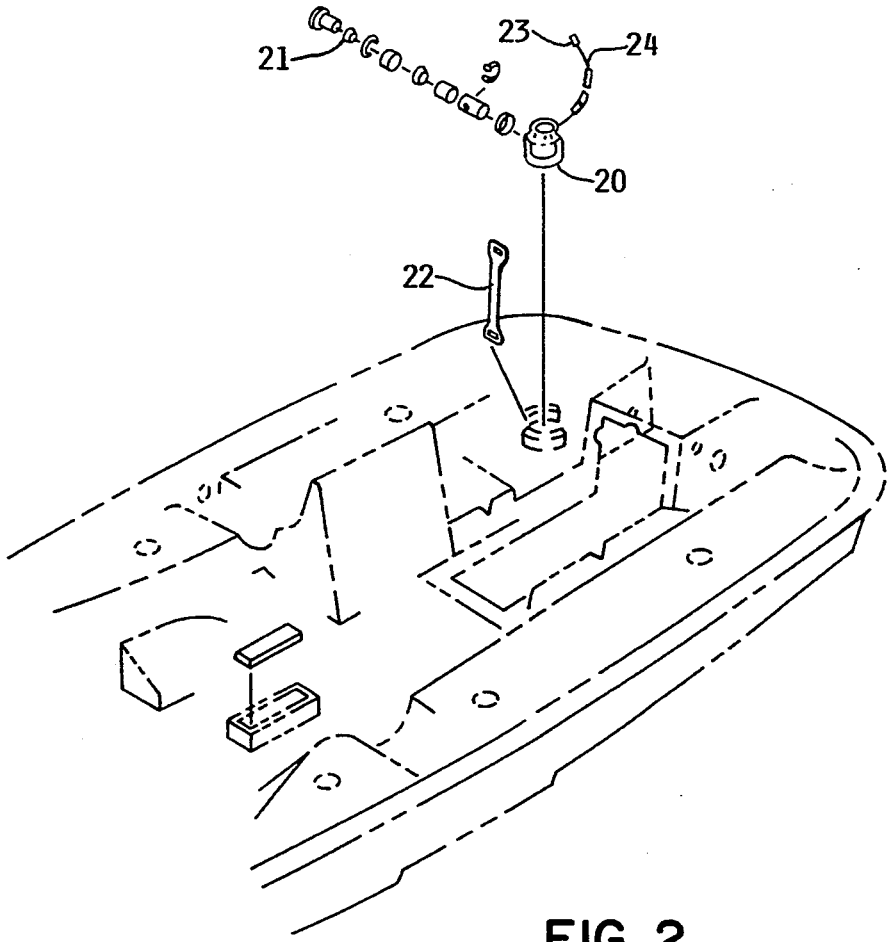
FIG. 2 is an exploded view of the interior portion of the hull of a personal watercraft, with parts of the bilge pump broken away to indicate the respective locations and interconnections of each part.

The location and components of bilge pump assembly 19, including bilge pump 20, bilge outlet 21, strap 22, and electrical wires 23 and 24 are shown in FIG. 2.

Figure 3:
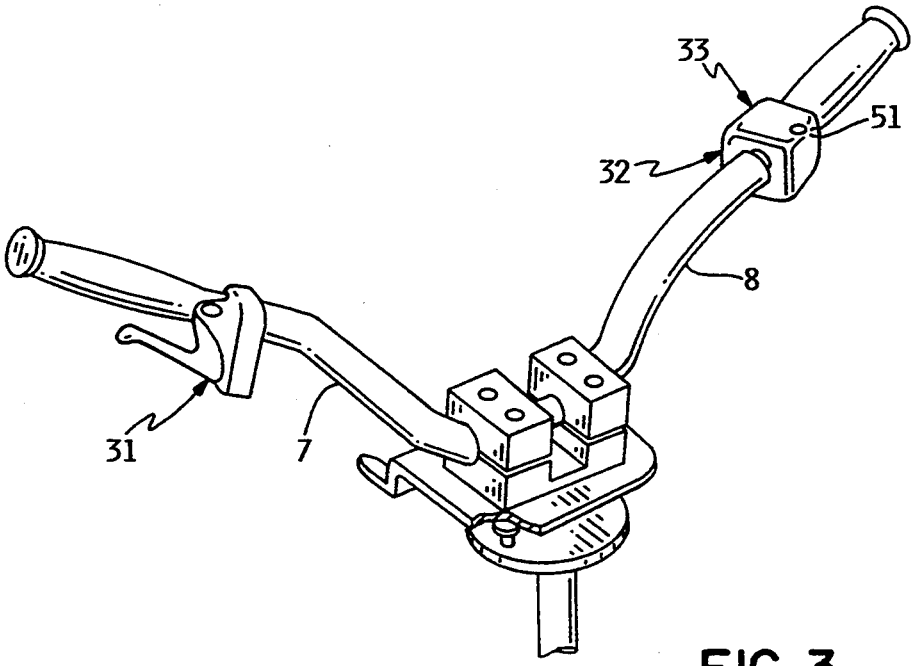
FIG. 3 is a perspective view of a preferred embodiment of the invention with a bilge pump control switch located on the handlebars of a personal watercraft.

FIG. 3 is a closeup view of handlebars 7 and 8, showing the location of a switchbox containing throttle control 31, start switch 32, tether stop switch 33 and bilge pump switch 51.

Figure 4:
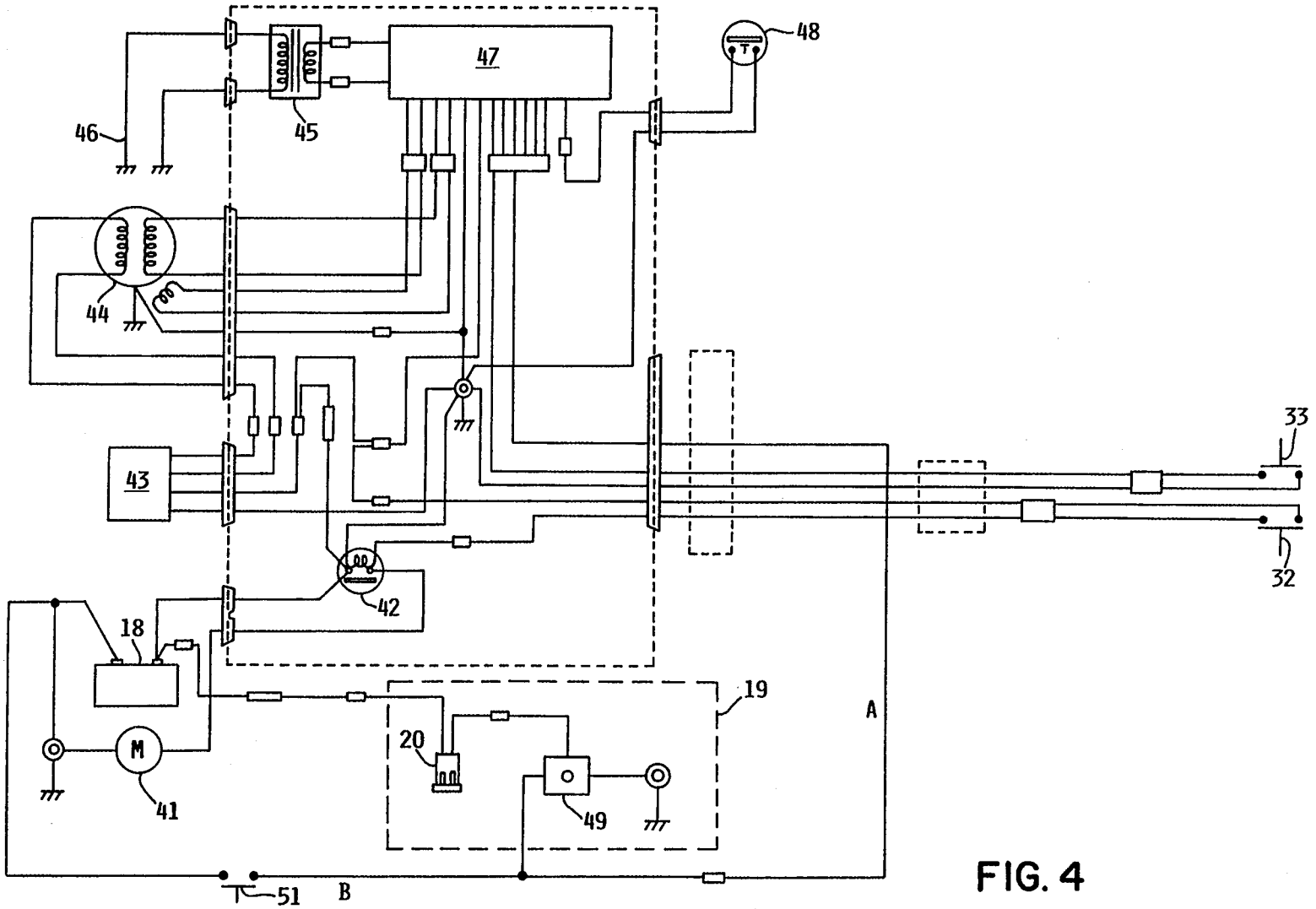
FIG. 4 is a circuit diagram of the electrical system of a personal watercraft, indicating electrical connections of a preferred embodiment of the invention.
Figure 5A:
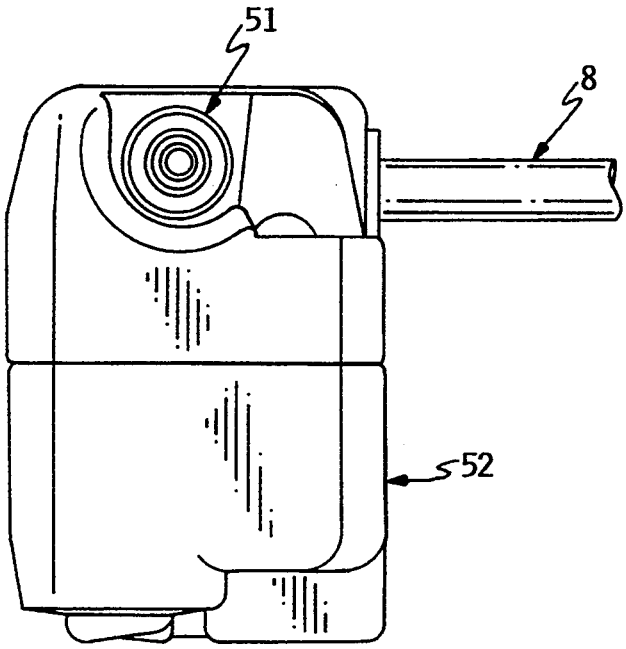
FIG. 5 A–D depicts the top, side, rear and rear views, respectively, of a preferred embodiment of a bilge pump control switch that is mounted on a handlebar of the personal watercraft.
Figure 5B:
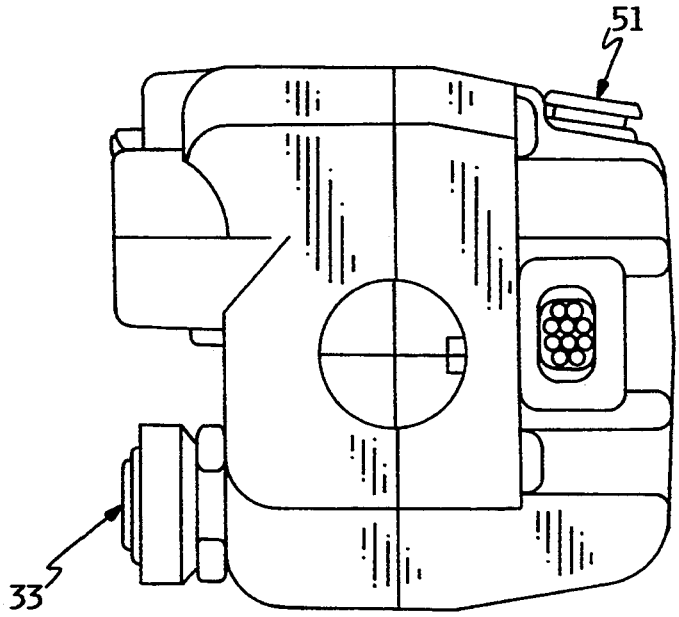
Figure 5C:
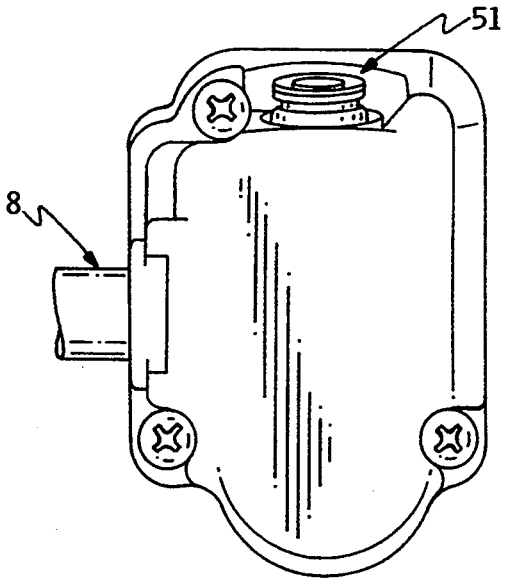
Figure 5D:
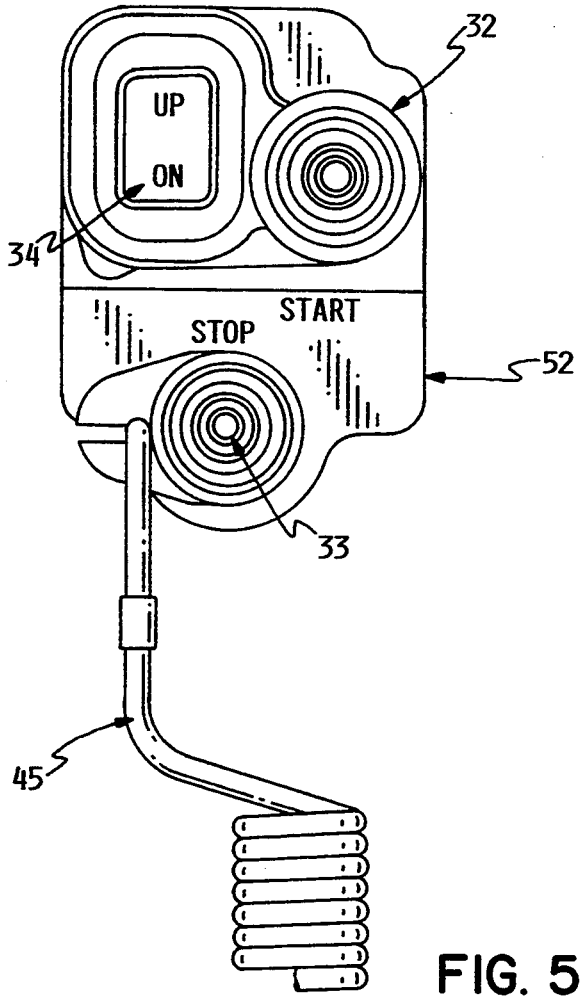

FIG. 4 shows a preferred electrical circuit used to practice the invention. Activation of the engine necessarily closes a connection between the battery 18 and bilge pump 20, through circuit A. Circuit A contains the usual components found in a personal watercraft, viz. battery 18, starter 41, solenoid 42, regulator/rectifier 43, stator 44, ignition coil 45, spark plugs 46, CDI unit 47, temperature switch 48, stop switch 33, start switch 32, and bilge pump assembly 19, containing a bilge pump module 49 and bilge pump 20.

Bilge pump switch 51 provides an alternative circuit B by which bilge pump 19 may be powered by battery 18.

A preferred embodiment of the invention, as described above, involves placement of a bilge pump control switch on a handlebar of the vessel. Such a switch is shown in FIG. 5: a push-button type switch 51 mounted on the top face of box 52 that also contains start switch 32, tether stop switch 33, and switch 34 for adjusting the vessel's trim. The preferred locations of switches 32, 33 and 34 are shown in FIG. 5 D, which is the front face of the switchbox—directed toward the operator. FIG. 5 D also shows tether 45 which is connected to the tether key switch (not shown). The engine operates only when the tether key is inserted in tether stop switch 33. The tether is securely fastened to the operator, usually by wrapping about an arm, thereby providing a means of stopping the engine should the operator be dislodged from the vessel for any reason. A switch box of a type suitable for housing all of these switches is commercially available from the Asahi Denso Company, Ltd., of Japan.

Other preferred embodiments of the invention include the attachment of bilge switch 51 at alternative sites upon the watercraft 10 in FIG. 1. Bilge switch 51 may be located on handlebar hub 6, or on hull 3, e.g. as indicated by position 41.

Although the preferred embodiments of the invention have been described herein, it should be understood that the invention may be embodied in other specific forms without departing from the spirit or essential characteristics thereof. The embodiments presented herein are therefore to be considered in all aspects as illustrative, rather than restrictive. Indeed, the intended scope of the invention is set forth in the following claims.

We claim:

1. A jet propulsion personal watercraft comprising:

A. a buoyant hull;

B. a jet impeller drive assembly;

C. an engine within the buoyant hull for driving the jet impeller drive assembly to produce a rearward flow of jet propelled water;

D. a handlebar steeringly connected to the jet impeller drive assembly for directing the flow of water;

E. a bilge pump control system comprising:

1. an electrically powered bilge pump;
2. an electrical power supply in electrical connection with the bilge pump;
3. a first activation means comprising an engine start switch in electrical connection with the electrical power supply and the bilge pump such that when the engine start switch is deactivated, the power supply is disconnected from the bilge pump and the bilge pump does not operate;
4. a second activation means comprising a manual switch in electrical connection between the electrical power supply and the bilge pump such that when the manual switch is activated, the bilge pump operates.

2. An apparatus as recited in claim 1, wherein the engine start switch being located on the handlebar.

3. An apparatus as recited in claim 1, wherein the manual switch being located on the handlebar.

* * * * *